United States Patent [19]

Rampe

[11] 4,184,290

[45] Jan. 22, 1980

[54] UNLOADING SYSTEM FOR BOWL-TYPE VIBRATORY FINISHING MACHINE

[75] Inventor: John F. Rampe, Mayfield Heights, Ohio

[73] Assignee: Rampe Research, Cleveland, Ohio

[21] Appl. No.: 893,630

[22] Filed: Apr. 5, 1978

Related U.S. Application Data

[63] Continuation-in-part of Ser. No. 714,823, Aug. 16, 1976, Pat. No. 4,091,575.

[51] Int. Cl.[2] ..... B24B 31/06

[52] U.S. Cl. ..... 51/163.2

[58] Field of Search ..... 51/163.1, 163.2, 7

[56] References Cited

U.S. PATENT DOCUMENTS

| | | | |
|---|---|---|---|
| 3,633,321 | 1/1972 | Rise | 51/163.2 |
| 4,001,979 | 1/1977 | Elkins | 51/163.2 |
| 4,081,929 | 4/1978 | Jones | 51/163.2 |

FOREIGN PATENT DOCUMENTS

| | | | |
|---|---|---|---|
| 2425095 | 12/1975 | Fed. Rep. of Germany | 51/163.2 |

*Primary Examiner*—Harold D. Whitehead
*Attorney, Agent, or Firm*—Burge & Porter Co.

[57] ABSTRACT

A system for unloading finished workpieces from a bowl-type vibratory finishing machine utilizes a structure defining a channel overlying a portion of the bowl, and a removable ramp member which is insertable into and removable from the bowl for selectively directing finishing media and finished workpieces from the bowl into the channel. The channel is provided with a screen through which media entering the channel will fall back into the bowl and across which finished workpieces entering the channel will pass for discharge. The ramp member is of novel, foldable construction to facilitate its insertion into and removal from the bowl. In preferred practice, the floor of the bowl is provided with a mound-shaped formation having a substantially horizontally extending top surface. The ramp member has an upper end region which is engageable with the channel-defining structure and a lower end region which is engageable with the mound-shaped formation. The ramp member cooperates with the mound-shaped formation to direct finishing media and finished workpieces from the floor of the bowl upwardly into the channel. The mound-shaped formation is hollow and provides passages for channeling fines and liquids from the bowl to drain.

21 Claims, 6 Drawing Figures

UNLOADING SYSTEM FOR BOWL-TYPE VIBRATORY FINISHING MACHINE

CROSS-REFERENCE TO RELATED APPLICATION

The present application is a continuation-in-part of application Ser. No. 714,823 filed Aug. 16, 1976 entitled Bowl-Type Vibratory Finishing Machine, issued May 30, 1978 as U.S. Pat. No. 4,091,575, here the "Bowl Machine Patent", the disclosure of which is incorporated by reference.

BACKGROUND OF THE INVENTION

1. Field of the Invention

The present invention relates generally to vibratory finishing and, more particularly, to an unloading system for discharging workpieces from a bowl-type vibratory finishing machine.

2. Prior Art

Unloading systems have been proposed for use with bowl-type vibratory finishing machines. Many of these proposals call for the use of a removably positioned ramp to direct a mixture of finishing media and workpieces onto a screen which overlies the bowl. The screen effects separation of the finishing media from the workpieces. As the workpieces travel across the screen for discharge, the media drops through the screen back into the bowl.

Difficulties have been encountered with previous unloading system proposals in inserting ramps into and removing ramps from a loaded bowl. During machine operation, the mixture of workpieces and finishing media in the bowl is churning and precessing in a predetermined direction. The mass of this mixture and the forces generated during its movement tend to inhibit ramp insertion and removal. While proposals have been made to provide pivotal systems for positioning the ramp, such systems require that a relatively rigid, planar ramp structure be forced down into a moving mixture during insertion, and require that the ramp structure be forced upwardly out of the moving mixture during removal. In most instances, the forces required to effect insertion and/or removal of the ramp are significantly greater than is desired, and the operations of inserting and removing the ramp are awkward and difficult to carry out.

As is known in the art, it is oftentimes desirable to form at least one of the side walls of a finishing machine bowl such that it tapers to provide a bowl cross section which narrows in width near the top of the bowl. Such a tapering of one or both of the side walls operates, in many instances, to enhance the type of churning movement which is imparted to the mixture of finishing media and workpieces. A problem which has been encountered with proposed unloading systems is that their removable ramps are of rigid construction and are difficult, if not impossible, to insert in bowls having tapered cross sections which narrow toward the top of the bowls. This problem has caused some manufacturers to utilize bowls having side walls which do not taper but rather extend substantially vertically, thereby losing the benefit which obtains from providing bowl side walls with a tapered configuration.

SUMMARY OF THE INVENTION

The present invention overcomes the foregoing and other drawbacks of the prior art by providing a novel and improved unloading system for a bowl-type vibratory finishing machine. The system of the present invention utilizes a ramp which is foldable to facilitate insertion into and removal from the bowl.

A feature of the invention resides in the fact that, during insertion of the ramp into the bowl, the movement of the mixture of finishing media and workpieces tends to assist its being positioned in an unloading attitude. During ramp removal, center portions of the ramp are raised ahead of side portions of the ramp as the ramp is folded to permit the mixture of finishing media and workpieces to move around the sides of the ramp, thereby significantly reducing the forces required to effect ramp removal.

The foldable character of the ramp permits it to be utilized in conjunction with a finishing machine bowl which has tapered side walls defining a bowl cross section which narrows in width as it approaches the top of the bowl. While great difficulty has been encountered with previous ramp proposals in effecting insertion and removal of rigid ramps where bowl side walls have been tapered, the foldable character of the ramp of the present invention permits the ramp to be inserted into the bowl in a folded configuration and then unfolded to project its inner and outer sides toward the inner and outer side walls of the bowl regardless of the curved or tapering configuration presented by the side walls.

In accordance with more basic features of the invention, an unloading system includes a structure which defines a channel overlying a portion of the bowl. The structure includes a media separation device, such as a screen, defining a plurality of apertures of predetermined size through which media entering the channel will fall back into the bowl and across which finished workpieces entering the channel will pass for discharge. A ramp member is provided for selectively directing media and finished workpieces from the bowl into the channel. The ramp member is insertable into and removable from the bowl and is foldable to facilitate its insertion and removal. The ramp member has an upper end region which is engageable with the channel-defining structure and a lower end region which is insertable into the bowl. The ramp is foldable about an axis extending between the upper end region and the lower end region. The ramp member has inner and outer side portions which are positionable along the inner and outer side walls of the bowl when the ramp is in an unloading position. The side portions of the ramp cooperate with the side walls of the bowl to form a trough for directing media and finished workpieces from the bowl into the channel.

The lower end of the ramp is preferably arranged to be received and supported near the top surface of a mound-shaped formation provided in the floor of the bowl. The mound-shaped formation has a first inclined wall portion which cooperates with the ramp to direct finishing media and finished workpieces from the floor of the bowl upwardly into the channel. The mound-shaped formation has a second inclined wall which, when the ramp is removed from the bowl, operates to direct finishing media and workpieces back downwardly toward the floor of the bowl. Both of the inclined walls of the mound-shaped member are preferably provided with strainer plugs for facilitating the discharge of fines and liquid from the bowl. In many finishing situations the presence of the mound-shaped member in the bowl facilitates the establishment of a desirable type of churning and intermixing action of the workpieces and finishing media prior to the time when the ramp is inserted in the bowl to effect discharge of finished workpieces.

As will be apparent from the foregoing summary, it is a general object of the present invention to provide a novel and improved unloading system for bowl-type vibratory finishing machines.

It is a further object of the present invention to provide a novel of unloading finished workpieces from a bowl-type vibratory finishing machine.

Another object of the present invention is to provide a bowl-type vibratory finishing machine unloading system which utilizes a foldable ramp.

Still another object is to provide an unloading system for a bowl-type vibratory finishing machine wherein a removable ramp of foldable character is utilized to facilitate insertion of the ramp into the bowl and removal of the ramp from the bowl.

These and other objects, and a fuller understanding of the invention, may be had by referring to the following description and claims taken in conjunction with the accompanying drawings.

DESCRIPTION OF THE PREFERRED EMBODIMENT

Figure 1:
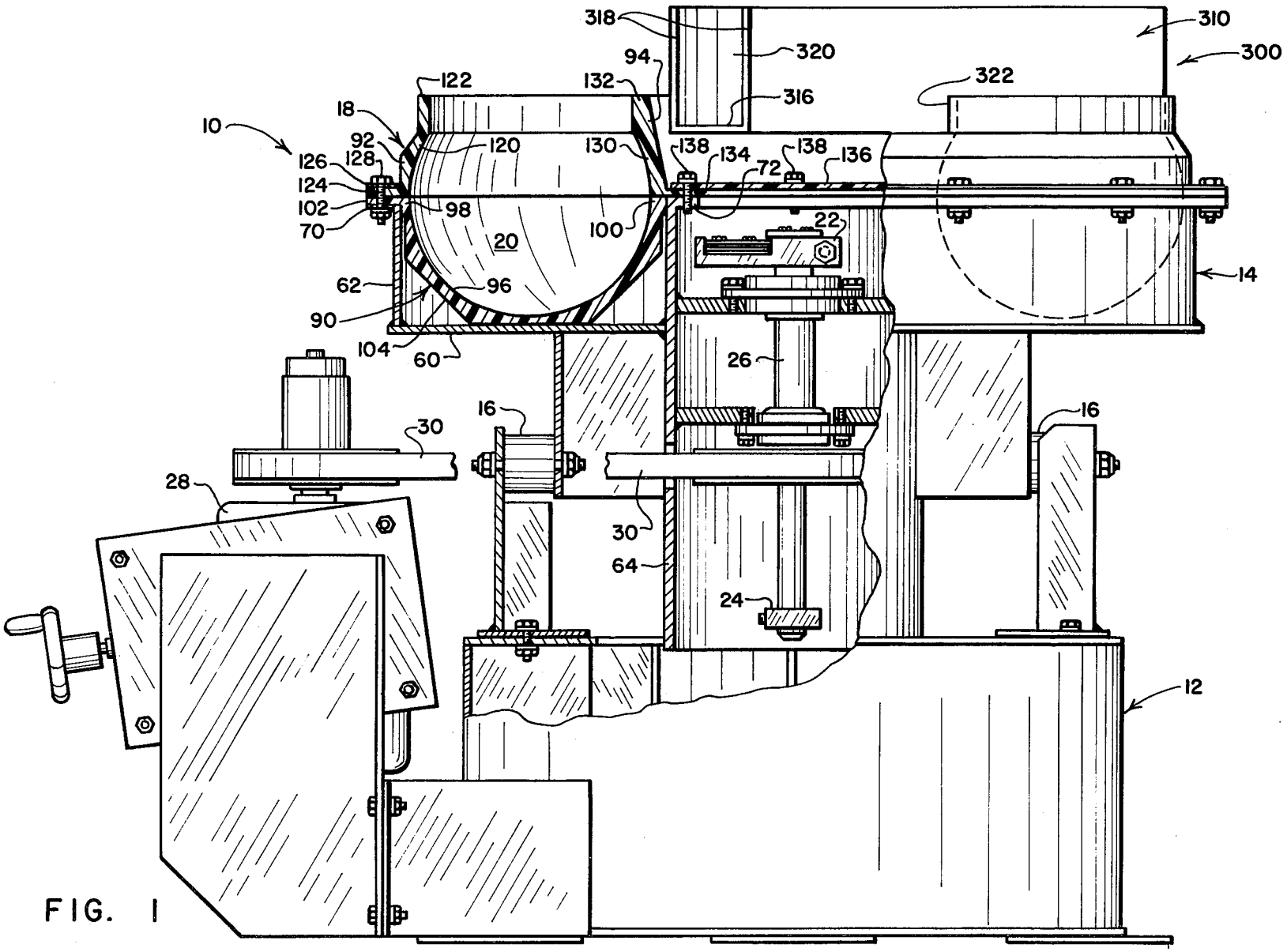
FIG. 1 is a side elevational view of a bowl-type vibratory finishing machine with portions broken away and shown in cross section, the machine incorporating an unloading system embodying the preferred practice of the present invention.

Referring to FIG. 1, a vibratory finishing machine is in indicated generally by the numeral 10. The machine 10 includes a base structure 12 and a bowl structure 14. Elastomeric mounts 16 resiliently interconnect the structures 12, 14 and permit relative movement therebetween. A replaceable liner assembly 18 forms part of the bowl structure 14 and defines an annular finishing chamber 20 for receiving media and workpieces to be finished. Vibratory movements are imparted to the bowl structure 14 by a drive system which includes a pair of eccentric weights 22, 24 supported on opposite ends of a rotatable shaft 26, a motor 28, and a belt 30 which drivingly interconnects the shaft 26 and the motor 28. A vibratory finishing machine of this type is described in detail in the referenced Bowl Machine Patent, the disclosure of which is incorporated herein by reference.

As is explained in detail in the referenced Bowl Machine Patent, the bowl structure 14 has welded framework including a bottom wall 60, a side wall 62, and an upstanding center tube 64. The bottom wall 60 is of annular configuration and is perimetrically welded to the side wall 62. The side wall 62 is of cylindrical configuration, extends upwardly from the bottom wall 60, and has a peripherally extending rim 70. The center tube 64 extends through and is welded to the bottom wall 60. An inwardly turned rim 72 is formed on the upper end of the center tube.

The bowl liner assembly 18 includes a substantially semi-torroidal shaped floor member 90, an outer extension member 92, and an inner extension member 94. The members 90, 92, 94 are separately molded from a relatively stiff lining material such as urethane elastomer having a hardness of about ninety durometers. An adhesive, liquid sealant is preferably used between abutting surfaces of the members 90, 92, 94 to enhance the formation of fluid-tight seals therebetween once the members are clamped together.

The floor member 90 has a rounded inner wall 96 which extends between coplanar outer and inner rim portions 98, 100. The outer rim portion 98 includes a mounting flange 102 which overlies side wall rim 70. The inner rim portion 100 is molded to extend slightly above the center tube rim 72 so that it is compressed downwardly when the inner extension member 94 is clamped in place. The floor member 90 has an outer wall 104 which engages the center tube 64 and the side wall 62 only at locations adjacent the rim portions 98, 100. The outer wall 104 is relieved in areas below the rim portions 98, 100 and makes no other contact with the center tube 64 or the side wall 62. The outer wall 104 has a flat bottom surface 114 which engages the bottom wall 60. The relieved configuration of the outer wall 104 facilitates insertion of the liner member 90 into the annular trough defined by the bottom and side wall and the center tube 60, 62, 64, and facilitates the establishment of an effective clamping action which holds the floor member 90 in place.

The outer extension member 92 has an inner wall 120 which curves inwardly and upwardly from the outer rim portion 98, extending the arcuate curve defined by the inner wall 96 and effectively tapering to narrow the cross section of the bowl near the top of the bowl. Near the top of the extension member 92, the inner wall 120 extends vertically upwardly and terminates in a top surface 122. The outer extension member 92 has a circumferentially extending mounting flange 124 which rests atop the mounting flange 102. A metal ring 126 overlies the mounting flange 124. Threaded fasteners 128 extend through aligned holes formed in the ring 126, in the mounting flanges 124, 102 and in the rim 70 to rigidly connect the liner members 90, 92 to the rim 70. The fasteners 128 clamp the outer extension member 92 downwardly into engagement with the floor member rim portion 98 and cause a fluid tight seal to be formed between the liner members 92, 96.

The inner extension member 94 has an inner wall 130 which curves inwardly and upwardly from the inner rim portion 100, extending the arcuate curve defined by the inner wall 96 and effectively tapering to narrow the cross section of the bowl near the top of the bowl. Near the top of the extension member 94, the inner wall 130 extends vertically upwardly and terminates in a top surface 132. The inner extension member 94 has a radially inwardly extending mounting flange 134 which rests atop the rim portion 100 and overlies the center tube rim 72. A cover 136 rests atop the mounting flange 134 and closes the open upper end of the center tube 64. Threaded fasteners 138 extend through aligned holes formed in the cover 136 and in the mounting flanger 134, and are threaded into holes formed in the center tube rim 72. The fasteners 138 clamp the inner extension member 94 downwardly into engagement with the floor member rim portion 100 and cause a fluid tight seal to be formed between the liner members 94, 96.

Figure 3:
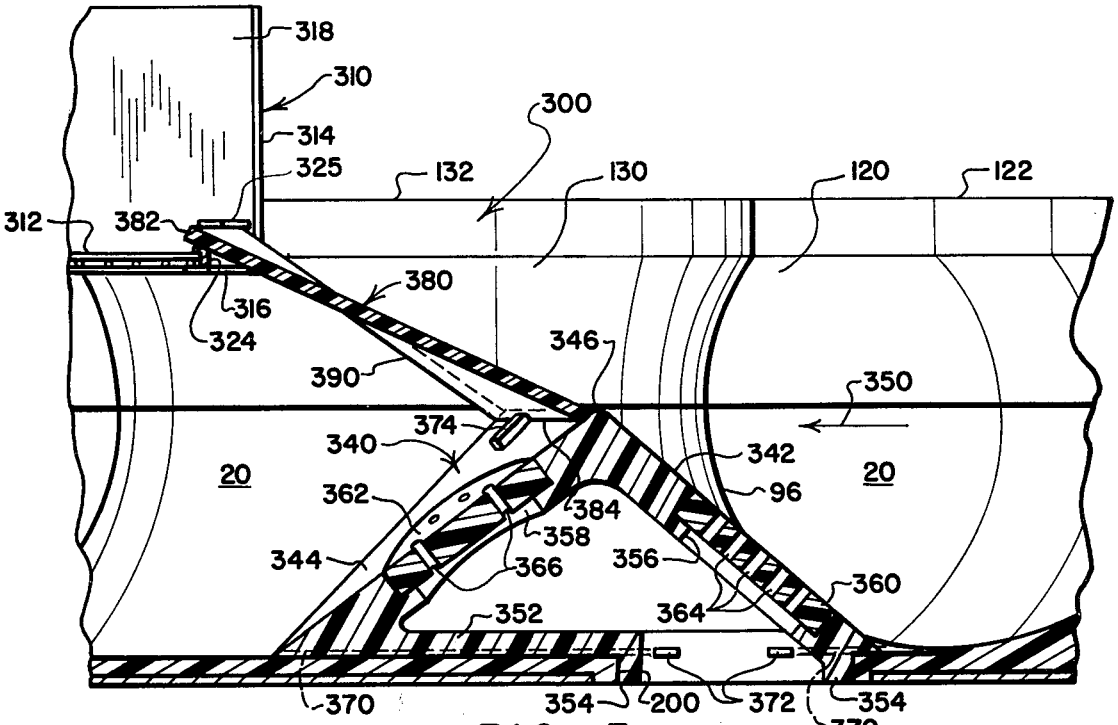
FIG. 3 is a sectional view as seen from planes indicated by a broken line 3—3 in FIG. 2.

Referring to FIG. 3, an opening to 200 is formed through the bottom of the floor member 90. As is explained in the referenced Bowl Machine Patent, the opening 200 provides a passsage for the discharge of fines and liquid from the chamber 20.

In accordance with the preferred practice of the present invention, the machine 10 is provided with an unloading system indicated generally by the numeral 300. The unloading system 300 includes a channel-defining structure 310, a mound-shaped structure 340, and a ramp member 380. The channel-defining structure 310 includes a screen 312 which overlies a portion of the finishing chamber 20. The ramp member 380 is insertable into the chamber 20 and is cooperable with the mound-shaped structure 340 to direct finishing media and finished workpieces from the floor of the chamber 20 upwardly into the channel-defining structure 310, whereupon finishing media drops through the screen 312 back into the chamber 20 as finished workpieces travel across the screen 312 for discharge.

Referring to FIGS. 1–4, the channel-defining structure 310 has a housing 314 including bottom wall 316 and a pair of upstanding side walls 318 which define an elongate channel 320. A slot 322 is formed in the upstanding wall of the outer extension member 92 to permit the housing 314 to extend therethrough. The housing 314 is of elongate construction having an inner end 324 and an outer end 326. The inner end 324 overlies the chamber 20. A ramp retaining log 325 is carried near the inner wall side of the inner end 324 and serves to overlie the inner corner of the upper end of the ramp member 380 to releasably retain the ramp member 380 in its unloading position, as will be described in greater detail. The outer end 326 is located radially outwardly from the chamber 20 and can be utilized to direct finished workpieces onto a conveyor (not shown) or into a hopper (not shown).

The screen 312 is positioned near the inner end 324 and overlies an opening 328 formed through the bottom wall 316. The screen 312 defines a plurality of apertures of predetermined size through which the particular type of finishing media being used in the chamber 20 will pass while permitting finished workpieces to pass thereover for discharge through the outer end 326. The screen 312 is removable and may be readily replaced with screens having apertures of other sizes as may be required to accommodate various sizes and types of finishing media and workpieces.

Figure 2:
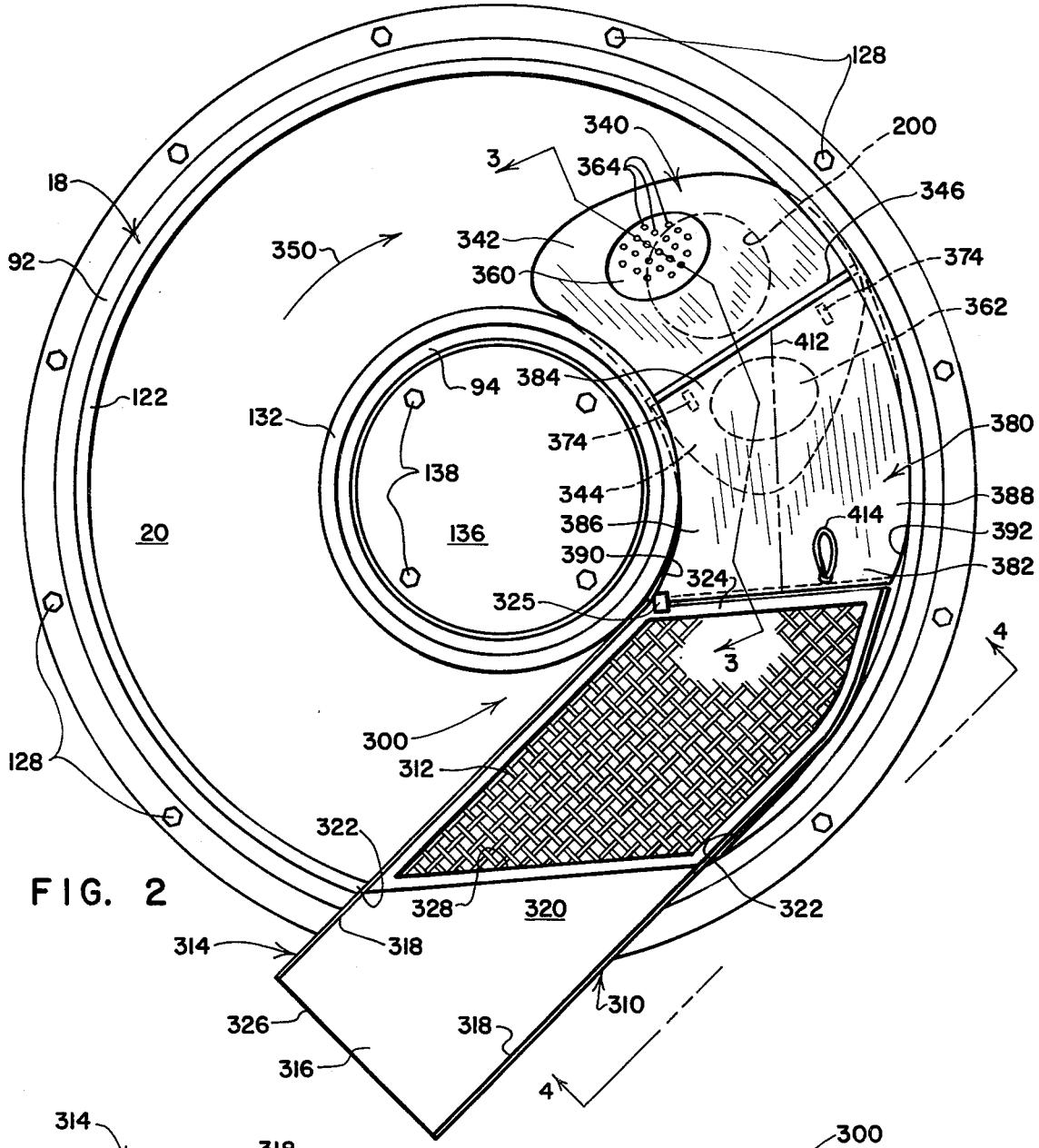
FIG. 2 is a top plan view of the machine of FIG. 1.
Figure 4:
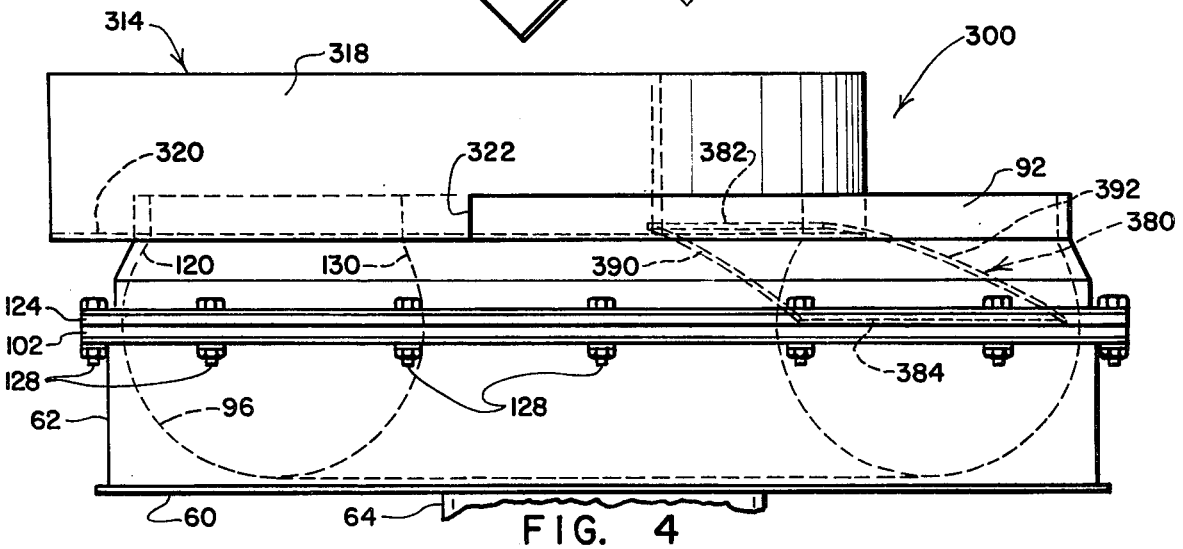
FIG. 4 is a side elevational view of portions of the machine of FIG. 1 as seen from a plane indicated generally by a line 4—4 in FIG. 2.

Referring to FIGS. 2 and 3, the mound-shaped structure 340 is formed from relatively stiff plastics material such as urethane elastomer and may either be bonded to the floor of the chamber 20 or clamped in place by conventional fastening means (not shown). As is best seen in FIG. 3, the mound-shaped structure 340 has first and second ramp-shaped portions 342, 344 which extend upwardly from the floor of the chamber 20 to a substantially horizontally extending top surface 346. As is best seen in FIG. 2, the top surface 346 extends substantially radially with respect to the bowl. The first ramp-shaped portion 342 is located upstream from the top surface 346 along the path of movement of finishing media and workpieces in the chamber 20. The second ramp-shaped portion 344 is located downstream from the top surface 346 along the media and workpiece travel path.

In normal finishing operation of the machine 10, finishing media and workpieces being finished churn about in the chamber 20 and precess through the chamber 20 along a path indicated generally by arrows 350. During its precession, the mixture of media and workpieces travels upwardly across the first ramp-shaped portion 342, across the top surface 346, and downwardly across the second ramp-shaped portion 344. In many instances, the presence of the mound-shaped structure 340 in the chamber 20 enhances the churning and finishing action imparted to the mixture.

The mound-shaped structure 340 is hollow and overlies the bowl discharge opening 200. The structure 340 has a bottom wall 352 with a depending annular rim 354 extending into the discharge opening 200 to communicate the hollow interior of the mound-shaped structure with the drain opening 200. Openings 356, 358 are formed through the ramp-shaped portions 342, 344, respectively. A pair of drain plugs 360, 362 are positioned in the openings 356, 358. Holes 364, 366 are provided through the plugs 360, 362. The holes 364, 366 communicate the chamber 20 with the interior of the mound-shaped structure 340 and operate to direct fines and liquids from the chamber 20 to discharge through the opening 200. In preferred practice, a plurality of grooves 370 are formed in the bottom surface of the bottom wall 352. The grooves 370 open into the chamber 20 and open through slot-like openings 372 for discharging fines and liquid from the chamber 20 into the discharge opening 200.

Referring to FIGS. 2 and 3, a pair of ramp-supporting projections 374 are formed on the second ramp-shaped portion 344 near the top surface 346. The projections 374 serve to retain the ramp member 380 in an operating position, as will be described.

Figure 5:
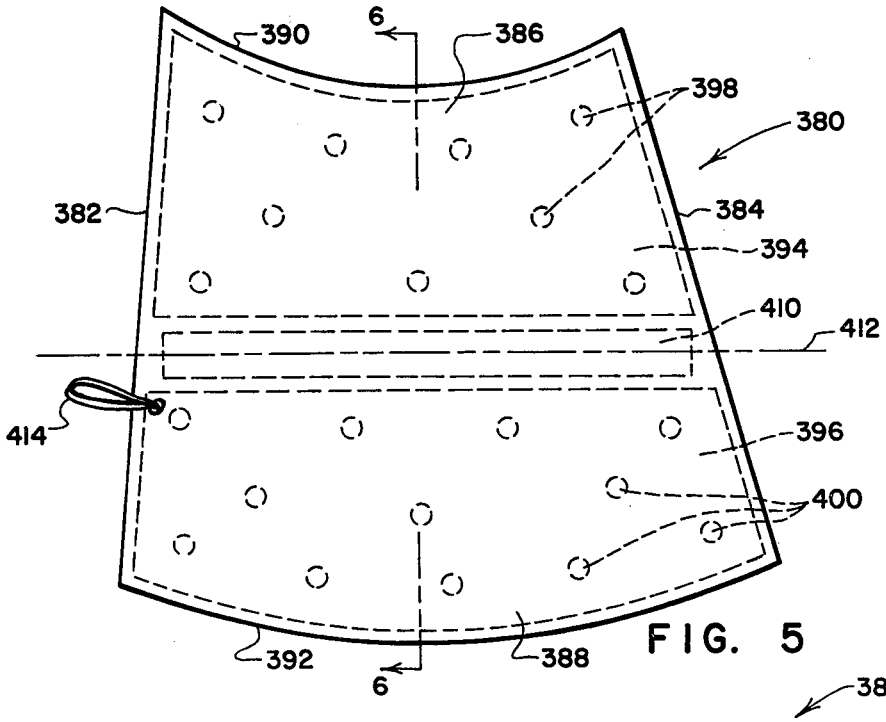
FIG. 5 is a top plan view of a removable, foldable ramp utilized in the separation system of the present invention; and, FIG. 6 is a sectional view as seen from a plane indicated generally by a line 6—6 in FIG. 5.
Figure 6:
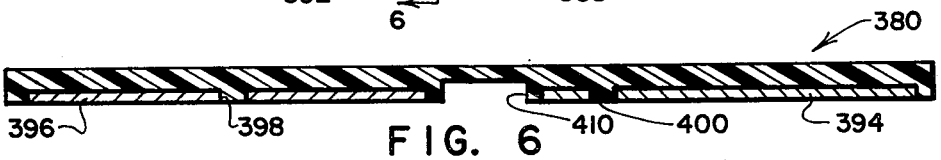

Referring to FIGS. 5 and 6, the ramp member 380 is a normally flat structure having opposite end regions 382, 384 and opposite side portions 386, 388. The end region 382 is engageable with the channel-defining structure 310 and will be referred to as the upper end region 382. The end region 384 is engageable with the mound-shaped structure 340 and will be referred to as the lower end region 384. The inner side portion 386 has a curved edge 390 configured to lie closely along the curved inner side wall 130. The outer side portion 388 has a curved edge 392 configured to lie closely along the curved outer side wall 120. When the ramp member 380 is in the operating position shown in FIGS. 2 and 3, the inner and outer edges 390, 392 lie closely along and cooperate with the curved inner and outer side walls 130, 120 to define a trough for directing finishing media and finished workpieces upwardly from the floor of chamber 20 into the channel-defining structure 310.

Steel reinforcing members 394, 396 are embedded in the side portions 386, 388. Holes 398, 400 are formed through the reinforcing members 394, 396. The plastics material which forms the side portions 386, 388 extends through the holes 398, 400 to assist in anchoring the reinforcing members 394, 396 to the plastics material.

The ramp member 380 has a center portion 410 of reduced cross section to facilitate folding of the member substantially about an axis indicated in FIGS. 1 and 5 by the numeral 412. A handle strap 414 is secured to the ramp member 380 at a location near the upper end of the folding axis 412 to facilitate removal of the ramp member 380 from the bowl.

The foldable character of the ramp member 380 facilitates its being inserted into and removed from the bowl. The insertion sequence for the ramp member 380 is initiated by folding the ramp member 300 about the axis 412 and inserting the lower end region 384 of the folded ramp member 300 into the churning mixture of media and workpieces in the bowl. The lower end region 384 is brought into engagement with the ramp supporting projections 374 whereupon the ramp member 380 is unfolded to lie flat with its inner and outer side portions 386, 388 extending along the inner and outer side walls 130, 120 of the bowl. The inner corner of the upper end region 382 is received beneath the ramp retaining lug 325 as the ramp member 380 is inserted and unfolded to assume its unloading position. Once the ramp member 380 is inserted and unfolded to form a flat ramp structure, its upper end region 382 is supported across its entire width by engagement with the inner end 324 of the housing 314.

The ramp member removal sequence is initiated by pulling upwardly on the handle strap 414 to pull the inner corner of the upper end region 382 out from under the ramp retaining lug 325 and to initiate folding of the ramp member 380, whereupon the media and workpiece mixture begins flowing around both side portions 386, 388 of the ramp member 380 between the edges 390, 392 and the inner and outer side walls 130, 120 of the bowl. As the handle strap 414 is pulled farther upward, the ramp member 380 is withdrawn with ease from the bowl.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

I claim:

1. In a vibratory finishing machine of the type including a base, a bowl adapted to receive finishing media and workpieces to be finished therein, means movably supporting the bowl on the base, and a drive system for vibrating the bowl relative to the base to effect a churning and precessing of media and workpieces in the bowl to impart a finishing action to the workpieces, the improvement of a system for unloading finished workpieces from the bowl, comprising:

(a) structure defining a channel overlying a portion of the bowl and including media separation means defining a plurality of apertures of predetermined size through which media entering the channel will fall back into the bowl and across which finished workpieces entering the channel will pass for discharge;

(b) ramp means including a ramp member which is insertable into and removable from the bowl for selectively directing media and finished workpieces from the bowl into the channel; and (c) the ramp member including first and second relatively rigid portions extending side-by-side and being connected by flexible means for rendering the ramp member foldable to facilitate its insertion into and removal from the bowl.

2. The machine of claim 1 wherein:

(a) the ramp member has an upper end region which is engageable with the channel-defining structure and a lower end region which is insertable into the bowl; and, (b) the flexible means extends between the upper end region and the lower end region defining an axis entending between the upper end region and the lower end region, about which axis the ramp member is foldable to facilitate its insertion into and removal from the bowl.

3. The machine of claim 2 wherein:

(a) the bowl has inner and outer side walls defining a substantially annular-shaped receptacle adapted to receive finishing media and workpieces to be finished; and, (b) the rigid portions of the ramp member comprise inner and outer side portions which are positionable along the inner and outer side walls, respectively, when the ramp member is inserted into the bowl to an unloading position for directing media and finished workpieces from the bowl into the channel.

4. The machine of claim 3 wherein:

(a) the inner and outer side walls of the bowl define a bowl cross-section of non-uniform width; and, (b) the inner and outer side portions of the ramp member are configured to correspond to the non-uniform cross-sectional width of the bowl such that the inner and outer side portions cooperate with the inner and outer side walls when the ramp member is in its unloading position to define a trough for directing media and finished workpieces from the bowl into the channel.

5. The machine of claim 4 wherein:

(a) the side walls of the bowl have portions which taper to define a bowl cross section which narrows in width as it extends upwardly; and, (b) the inner and outer side portions of the ramp member are configured to cooperate with the tapered portions of the side walls to define at least a part of said trough.

6. The machine of claim 1 wherein the relatively rigid portions and the flexible means are formed integrally with each other.

7. The machine of claim 6 wherein the ramp member is formed from plastics material and the first and second relatively rigid portions have rigidifying members embedded therein.

8. The machine of claim 1 additionally including a mound-shaped formation provided in the floor of the bowl and having a top surface located above the floor of the bowl with a first ramp-shaped portion extending on the upstream end of the mound-shaped formation from the floor of the bowl to the top surface for directing finishing media and workpieces thereacross as the mixture of media and workpieces precesses in the bowl in response to operation of the drive means, and having a second ramp-shaped portion extending on the downstream end of the mound-shaped formation for normally directing the mixture of finishing media and workpieces from the vicinity of the top surface back toward the floor of the bowl.

9. The machine of claim 8 wherein the top surface of the mound-shaped formation extends substantially horizontally.

10. The machine of claim 8 wherein the ramp member is engageable with the mound-shaped formation when the ramp member is inserted into the bowl and is cooperable with the mound-shaped formation to direct finishing media and finished workpieces from the floor of the bowl upwardly into the channel.

11. The machine of claim 10 wherein the lower end region of the ramp member is engageable with the mound-shaped formation in the vicinity of the top surface and operates, when engaged with the mound-shaped formation, as an extension of the first ramp-shaped portion to direct finishing media and finished workpieces from the floor of the bowl upwardly into the channel.

12. The machine of claim 11 wherein ramp member support means is provided on the second ramp-shaped portion near the top surface of the mound-shaped formation for releasably retaining the lower end region of the ramp member in engagement with the mound-shaped formation.

13. The vibratory finishing machine of claim 8 wherein the mound-shaped formation is hollow and operates to communicate the bowl with a discharge opening formed in the bottom of the bowl beneath the mound-shaped formation for discharging fines and liquids from the bowl.

14. The machine of claim 13 wherein at least one of the ramp-shaped portions of the mound-shaped formation is provided with an opening therethrough communicating the bowl with the hollow interior of the mound-shaped formation, and a plug is carried in the opening.

15. The machine of claim 14 wherein the plug is provided with a plurality of drain openings for communicating the bowl with the hollow interior of the mound-shaped formation.

16. The machine of claim 1 wherein ramp member retaining means is provided on the channel-defining structure for releasably retaining the ramp member in position once it has been inserted into the bowl in an unloading position for directing finishing media and finished workpieces upwardly into the channel.

17. The machine of claim 1 additionally including handle means connected to the ramp member for facilitating removal of the ramp member from the bowl.

18. A vibratory finishing machine comprising:

(a) a base structure;

(b) a receptacle adapted to receive finishing media and workpieces to be finished;

(c) means movably supporting the receptacle on the base structure;

(d) drive means for vibrating the receptacle relative to the base structure to cause a mixture of finishing media and workpieces in the receptacle to precess along a predetermined normal path of movement and to impart a finishing action to the workpieces;

(e) separation means located out of the normal path of movement and defining a plurality of apertures through which finishing media will pass for introduction back into the normal path of movement, and across which finished workpieces will pass for discharge;

(f) a foldable member adapted to be removably inserted into the receptacle for selectively directing finishing media and finished workpieces out of their normal path of movement and into the separation means for effecting separation of the media and workpieces and permitting discharge of the workpieces; and, (g) the foldable member including first and second relatively rigid portions extending side-by-side, and a flexible portion interposed between and connecting the relatively rigid portions.

19. The machine of claim 18 wherein the separation means is located above the normal path of movement and the foldable member is a ramp member which is insertable from above into the receptacle for diverting a mixture finishing media and finished workpieces upwardly out of its normal path of movement and into the separation means.

20. The machine of claim 19 additionally including a mound-shaped formation provided in the receptacle, and the ramp member is cooperable with the mound-shaped formation to direct finishing media and finished workpieces from the floor of the receptacle into the separation means.

21. The machine of claim 20 wherein the mound-shaped formation is hollow and operates to communicate the receptacle with a discharge opening for discharging fines and liquid from the receptacle.

* * * * *